United States Patent [19]

Abel et al.

[11] Patent Number: 4,494,952

[45] Date of Patent: Jan. 22, 1985

[54] WETTING AGENTS AND THEIR USE AS MERCERIZING ASSISTANTS

[75] Inventors: Heinz Abel, Reinach; Christian Guth, Basle both of Switzerland

[73] Assignee: Ciba Geigy Corporation, Ardsley, N.Y.

[21] Appl. No.: 527,600

[22] Filed: Aug. 29, 1983

[30] Foreign Application Priority Data

Sep. 8, 1982 [CH] Switzerland ..... 5336/82

[51] Int. Cl.[3] ..... D06M 1/02; B01F 17/02; B01F 17/12

[52] U.S. Cl. ..... 8/125; 252/353; 252/156

[58] Field of Search ..... 8/125; 252/353, 156

[56] References Cited

U.S. PATENT DOCUMENTS

| | | | |
|---|---|---|---|
| 2,794,004 | 5/1957 | Ratti | 252/353 |
| 3,449,261 | 6/1969 | Ross et al. | 252/353 |
| 3,890,093 | 6/1975 | Diery et al. | 8/125 |
| 3,893,937 | 7/1975 | Landauer et al. | 8/125 |

FOREIGN PATENT DOCUMENTS

| | | |
|---|---|---|
| 1048865 | 1/1959 | Fed. Rep. of Germany . |
| 192832 | 12/1937 | Switzerland . |
| 831220 | 3/1960 | United Kingdom . |

*Primary Examiner*—Maria Parrish Tungol
*Attorney, Agent, or Firm*—Edward McC. Roberts

[57] ABSTRACT

A wetting agent, in particular for mercerizing cotton and cotton blend fabrics, which contains (a) sulfates of a fatty alcohol having 6 to 18 carbon atoms,
(b) phosphates of a monoalcohol having 4 to 12 carbon atoms,
(c) alcohols having 6 to 18 carbon atoms or condensation products thereof with paraformaldehyde,
(d) a hydrotropic solubilizing agent and optionally
(e) an adduct of an organopolysiloxane and ethylene oxide and/or propylene oxide and/or
(f) a complexing agent.

The wetting agents are distinguished by great wetting power and low foaming, not only in the course of the mercerization but also in the recovery of liquor from mercerizing washing baths.

30 Claims, No Drawings

WETTING AGENTS AND THEIR USE AS MERCERIZING ASSISTANTS

The present invention relates to wetting agents which can be used, in particular, as mercerising assistants.

The mercerisation is a customary step in the processing of cellulosic fibre materials and involves treating these materials in aqueous alkaline liquors.

Wetting agents suitable for the mercerisation have been known for a long time. Swiss Patent specificaton No. 192,832 describes, for example, sulfates of ethylene oxide adducts of aliphatic alcohols which increase the wetting power of mercerising liquors. According to Swiss Patent specification No. 271,087, the wetting power of these liquors is increased by mixing alkylsulfuric acids with certain alcohols and ethers. It is also known, from German Patent specification No. 1,048,865, to use the sulfates of Swiss Patent specification No. 192,832 in a mixture with a branched fatty alcohol as a wetting agent in the mercerising of cotton yarn.

The strongly alkaline mercerising liquors containing these wetting agents in many cases, nevertheless, still have insufficient wetting power. What is more, these liquors can tend to gel, in particular at relatively low temperatures and high concentrations of alkali metal hydroxide. Their greatest disadvantage, however, must be that, in some cases, they foam very strongly in the course of the mercerisation and can thus hamper the processing severely, in particular on yarn-mercerising machines. The formation of voluminous foam layers, furthermore, also interferes with the concentrating and recovering of the alkali metal hydroxide solution from the washing baths following the mercerising bath.

Insufficient wetting and, in particular, excessive foaming are disadvantages which are observed especially in yarn-mercerising and on modern, high-speed mercerising machines. Since the goods to be mercerised move through the mercerisation bath at a high speed, they need to be wetted within a shorter period than on slower-working machines. The higher speed through the machine of the material to be mercerised generally leads to increased foaming on the bath. In yarn-mercerising, this increased foaming not only slows down the wetting of the yarn but also makes it less uniform. At the same time the concentration of mercerising liquor in the washing baths following the mercerising bath rises more rapidly. As a result, a continuous operation needs to recover, per unit time, more liquor from these washing baths. However, it is only possible to carry out the mercerisation and the liquor recovery within a shorter period if the degree of foaming is kept within limits and the wetting agent used has an efficient wetting action.

We have now found wetting agents which on use in mercerisation baths overcome the disadvantages mentioned and which exhibit efficient wetting and very low foaming.

The present invention therefore relates to wetting agents which contain (a) sulfates of a fatty alcohol having 6 to 18 carbon atoms and (b) phosphates of a monoalcohol having 4 to 12 carbon atoms, (c) alcohols having 16 to 18 carbon atoms or condensation products thereof with paraformaldehyde and (d) a hydrotrope.

The present invention also relates to the use of the wetting agents in the mercerising of cellulosic fibre materials, to the mercerising baths containing the wetting agents, to a process for mercerising cellulosic fibre materials, to the fibre material thus mercerised, and to a process for reducing the degree of foaming in the recovery of mercerising liquor from mercerising washing baths.

Component (a) in the wetting agents of the invention can be for example sulfates of fatty alcohols (esters of sulfuric acid) of the formula $$R_1—O—SO_3H. \quad (1)$$

The alkyl radical $R_1$ in this formula can be saturated or unsaturated, cyclic, branched or straight-chain. It preferably contains 6 to 18 carbon atoms and derives, for example, from hexanol, heptanol, octyl, nonyl and decyl alcohol, and also from lauryl, myristyl, cetyl, stearyl and oleyl alcohol. The sulfates of fatty alcohol having 6 to 12, in particular 8 or 9, carbon atoms are preferred. Particularly good results are obtained using the sulfates of branched isomers of said alcohols, for example 2-ethylhexanol, trimethylhexanol and trimethylnonyl alcohol. Said sulfates can be used in the wetting agents of the invention either on their own or as a (technical) mixture with one another.

The phosphates of a monoalcohol (esters of phosphoric acid) used as component (b) can be monoesters of the formula $$R_2—O—PO_3H_2, \quad (2a)$$

diesters of the formula $$(R_2—O—)_2PO_2H \quad (2b)$$

or a mixture of the esters of the formulae (2a) and (2b).

In these formulae, the $R_2$ radicals preferably contain 4 to 12, in particular 4 to 6, carbon atoms. Possible $R_2$ radicals have been listed in the explanation for component (a). Additional possibilities are radicals of amyl and, in particular, butyl alcohol. The phosphates can be used on their own or as a (technical) mixture with one another. Monobutyl phosphate is particularly suitable.

Component (c) can be for example the free fatty alcohols mentioned in the explanation for component (a). These fatty alcohols can also be used in the form of condensation products with paraformaldehyde $[(CH_2O)_x]$. Component (c), like components (a) and (b), can be used in the form of (technical) mixtures of the alcohols in question.

A component which can be used in combination with the above-mentioned components (a) to (d) as component (e) is an adduct of an organopolysiloxane preferably dimethylpolysiloxane, and ethylene oxide and/or propylene oxide. Adducts of this type can be represented by the probable formula

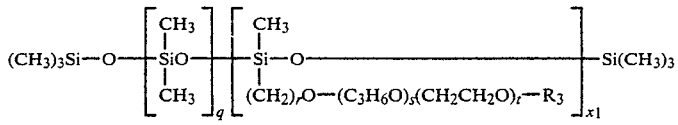

(3)

in which q is 3 to 50, preferably 3 to 25, r is 2 or 3, s is 0 to 15, t is 1 to 25, $x_1$ is 3 to 10, and $R_3$ is alkyl having 1 to 4 carbon atoms, preferably methyl.

Polyethersiloxanes of this type are described, for example, in German Patent specification No. 1,719,238 and in U.S. Pat. Nos. 2,834,748, 3,389,160 and 3,505,377.

Further polyethersiloxanes which can be used as the optional component (e) have the probable formula

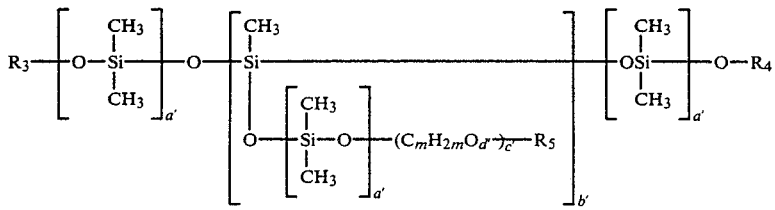

(4)

in which $R_3$ and $R_4$ each are alkyl having 1 to 4 carbon atoms, preferably methyl, a' is 1 to 20, b' is 2 to 20, c' is 1 to 50, d' is 1 or 2, preferably 1, and m is 2 to 5.

Siloxane compounds of this type are described in German Patent specification No. 1,795,557.

Preferred siloxane compounds, then, are those which have a cloud point of 20 to 70, in particular 25 to 50, °C.

The silicone surfactant L 546 ® (a commercial brand), for example, is a suitable commercially available component (e) which has the probable formula (3) and a cloud point of 32° C.

The wetting agents of the invention can contain further components, for example complexing agents (component (f). Suitable components (f) preferably have the formula

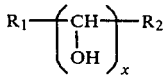

(5)

in which $R_1$ and $R_2$, independently of each other, are $-CH_2OH$, $-CHO$ or $-CO_2M$, M is hydrogen or an alkali metal, preferably sodium, and x is 2 to 5.

Particularly preferred compounds of the formula (5) are hydroxycarboxylic acids of the formula

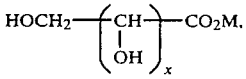

(6)

in which M and x are as defined above, or a lactone of these hydroxycarboxylic acids. Gluconic acid and glucoheptanoic acid, and their sodium salts, produce particularly good results.

Suitable components (d) preferably have the formula

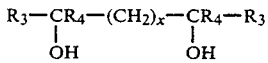

(7)

in which $R_3$ and $R_4$, independently of each other, are hydrogen or alkyl having 1 to 4 carbon atoms, in particular methyl, and x is as defined above.

In preferred compounds of the formula (7), x is 1 and $R_3$ and $R_4$, independently of each other, are hydrogen or methyl. 2-Methyl-2,4-pentanediol, for example, may be mentioned as a particularly useful compound.

Wetting agents of the invention which contain both component (d) and component (f) lead to particularly good results. Particularly noteworthy in this context is the combination of gluconic acid (sodium salt) with 2,4-dihydroxy-2-methylpentane.

Components (a), (b), (c) and (d) and optionally (e) and/or (f) are preferably used in the form of an aqueous solution.

The aqueous solutions of wetting agents according to the invention preferably contain 5–50% of component (a), 0.5–30% of component (b), 0.5–5% of component (c), 5–15% of component (d) and optionally 0.1–1% of component (e) and/or 0.1–5% of component (f).

Highly suitable wetting agents contain, in the form of an aqueous solution, 25–40% of component (a), 0.5–20% of component (b), 0.5–2% of component (c), 10–15% of component (d) and optionally 0.1–0.5% of component (e) and/or 2–4% of component (f).

Particularly preferred wetting agents contain, in the form of an aqueous solution, 30–35% of component (a), 0.5–10% of component (b), 1–1.5% of component (c), 10–15% of component (d), 0.1–0.5% of component (e) and 2–4% of component (f).

The wetting agents of the invention are suitable for use as dyeing and finishing assistants for cellulosic fibre materials. They are, in particular, useful wetting agents in the mercerising of these fibrous materials. For this purpose, the abovementioned aqueous solutions are used in amounts of 1–20, preferably 2.5–10, g per liter of mercerising liquor.

Cellulose fibres are made, for example, more lustrous by mercerising. Their absorptivity for dye and the tensile strength are improved at the same time. Mercerising involves treating the fibres with concentrated alkaline solutions (about 22–28%), for example with aqueous solutions of lithium hydroxide, sodium hydroxide or potassium hydroxide or mixtures thereof. As part of the treatment, the fibres can be subjected at the same time to a stretch whereby the lustre effect can be further increased.

The temperature of the mercerising liquors is preferably about 5° to 20° C. According to whether the fibres are mercerised in the dry, boiled or wetted state, the treatment is referred to as dry or wet mercerisation. Dry mercerisation, in particular, understandably necessitates the use of very effective wetting agents.

Cellulosic fibre materials are especially cotton and blend fabrics with regenerated celluloses, for example staple viscoses and filament viscoses (rayon). However, the mercerising of fabrics blended from natural (for example cotton, hemp and flax) and regenerated celluloses makes high demands on the concentration and composition of mercerising liquors, since the properties of the components of these blend fabrics diverge. For this reason, blend fabric is treated almost exclusively by dry mercerisation, so that additional (critical) contact of the blend fabric with boiling or wetting baths is avoided.

In industry, the mercerisation is carried out as yarn or piece mercerisation. A detailed description of these processes as well as of mercerisation in general is given, for example, in Lindner, Textilhilfsmittel und Waschrohstoffe [Textile Assistants and Detergent Bases], Wissenschaftliche Verlagsgesellschaft, Stuttgart, 1964, Volume 2, page 1474 et seq.

The wetting agents according to the present invention, in particular those which contain components (a) to (f), however, also make possible rapid and trouble-free recovery of the liquor from the (mercerising) washing baths following the mercerising bath. It is remarkable how little these wetting agents tend to foam as water is destilled out of these baths to raise the concentration of the liquor to the alkali content of the mercerising bath. The resulting concentrated liquor can then be re-used in the mercerising bath.

The inventive wetting agents thus at least match the state of the art in terms of wetting action, but on top of that they have the great advantage that their foaming tendency is low, for example at the liquor recovery stage mentioned.

The following examples illustrate the invention without restricting it. Parts and percentages are by weight, unless stated otherwise.

EXAMPLE 1

In this example, the shrinkage rate of cotton is determined in mercerising liquors in accordance with DIN No. 53,987 (German Industrial Standard, draft July 1973). In this method, a glass cylinder is filled with 150 ml of a cool sodium hydroxide solution (24%) at 15° C. which contains per liter 5 g of the wetting agent of the following composition: wetting agent of the following composition:

(a) 23.75% of the sulfate of 2-ethyl-n-hexanol,
(b) 25.0% of the phosphate of butanol,
(c) 1.0% of 2-ethylhexanol and
(e) 0.25% of the silicone surfactant L 546 ® (trade name) and 50.0% of water.

A cotton hank (weight: 1 g, length: 24 cm) which is loaded down with a weight of 33 g is then immersed into the filled cylinder, and the change in length of the hank is then measured at equal time intervals. The shrinkage rate which can be calculated therefrom is a measure of the effectiveness of the wetting agents used in the mercerising liquor.

A mercerising liquor used for comparison contains, as a wetting agent, only, per liter, 5 g of the sulfate of 2-ethyl-n-hexanol, and the shrinkage rate of an identical cotton hank is determined. The results have been collated in Tables 1(a) and 1(b).

TABLE 1a

| Time of immersion (sec) | Shrinkage in millimeters (mm) Wetting agent according to the invention (g/l) 1 | 3 | 5 | 7 | Comparison (g/l) 1 | 3 | 5 | 7 |
|---|---|---|---|---|---|---|---|---|
| 10 | 2 | 14 | 44 | 47 | 1 | 15 | 41 | 45 |
| 20 | 7 | 30 | 52 | 49 | 8 | 31 | 48 | 48 |
| 30 | 12 | 36 | 54 | 50 | 11 | 37 | 49 | 48 |
| 40 | 18 | 40 | | | 15 | 41 | 49 | 49 |
| 50 | 22 | 42 | | | 18 | 43 | 50 | 50 |
| 60 | 26 | 43 | | | 23 | 44 | | |
| 90 | 30 | 44 | | | 26 | 45 | | |
| 120 | 33 | 47 | | | 29 | 47 | | |

TABLE 1b

| Time of immersion (sec) | Shrinkage in percent Wetting agent according to invention (g/l) 1 | 3 | 5 | 7 | Comparison (g/l) 1 | 3 | 5 | 7 |
|---|---|---|---|---|---|---|---|---|
| 10 | 3.3 | 23.3 | 73.3 | 78.3 | 1.7 | 25.0 | 68.3 | 75.0 |
| 20 | 11.7 | 50.0 | 86.7 | 81.7 | 13.3 | 51.7 | 80.0 | 80.0 |
| 30 | 20.0 | 60.0 | 90.0 | 83.3 | 18.3 | 61.7 | 81.7 | 80.0 |
| 40 | 30.0 | 66.7 | | | 25.0 | 68.3 | 81.7 | 81.7 |
| 50 | 36.7 | 70.0 | | | 30.0 | 71.7 | 83.3 | 83.3 |
| 60 | 43.3 | 71.7 | | | 38.3 | 73.3 | | |
| 90 | 50.0 | 73.3 | | | 43.3 | 75.0 | | |
| 120 | 55.0 | 78.3 | | | 48.3 | 78.3 | | |

Using, per liter, for example 5 g of the wetting agent according to the invention a higher shrinkage is obtained after a mere 30 seconds than with the comparative wetting agent after 50 seconds.

EXAMPLE 2

This example demonstrates by means of the glass cylinder shaking test the foaming behaviour of mercerising liquors in the course of their application.

100 ml of sodium hydroxide solution (24%) which contains per liter 1 or 2 g of the wetting agent used in Example 1 are poured into a glass cylinder and raised to a temperature of 25° C. The glass cylinder is then vigorously shaken for 1 minute, and the height of the resulting foam is measured after certain times.

A mercerising liquor whose foaming behaviour is investigated for comparison contains per liter 1 or 2 g of the sulfate of 2-ethyl-n-hexanol in place of the wetting agent used above. The results can be seen from Table 2.

TABLE 2

| Wetting agent (g/Liter) | | Height of foam in millimeters (mm) immediately | after 1 min | 2 min | 5 min | 10 min |
|---|---|---|---|---|---|---|
| 1 | according to the invention | 26 | 0 | 0 | 0 | 0 |
| 2 | according to the invention | 30 | 0 | 0 | 0 | 0 |
| 1 | comparison | 56 | 48 | 46 | 40 | 38 |
| 2 | comparison | 82 | 78 | 70 | 58 | 56 |

While the comparative wetting agent permits, in some instances, very considerable foam heights, the wetting agent according to the present invention completely suppresses any formation of foam.

EXAMPLE 3

This example demonstrates the foaming behaviour in the course of liquor recovery of a washing bath used after the mercerising stage.

In a rotary evaporator, under about 10–20 mbar, water is distilled out of 500 ml of dilute mercerising liquor (15%) which contains 300 ml of sodium hydroxide solution (24%), 2.5 g of wetting agent as in Example 1 and 192.5 ml of water until the alkali concentration is back to 24%. The height of the foam formed in the course of distillation is measured as a function of time.

This process is repeated for comparison with 500 ml of a mercerising liquor which contains per liter 5 g of 2-ethyl-n-hexanol as a wetting agent.

TABLE 3

| Foam height in millimeters (mm) | | |
|---|---|---|
| Wetting agent | Boiling time (minutes) | Foam height (mm) |
| according to the invention | start of boil | 5 |
| | 35 | 2 |
| | 40 | 0 |
| | 60 | 5 |
| comparison | start of boil | |
| | 25 | 20 |
| | 35 | >70 |
| | 60 | >70 |

The wetting agent according to the invention markedly reduces the degree of foaming at the liquor recovery stage, compared with the comparative wetting agent.

EXAMPLE 4

This example demonstrates the effectiveness of the wetting agents according to the invention in strongly alkaline mercerising liquors.

Desized cotton fabric (weight: 180 g per square meter) is fixed without tension on a pin stenter and is dipped for 1 minute into a mercerising liquor which contains per liter 311.9 g of sodium hydroxide solution (which corresponds to a 25% solution) and 6 g of a wetting agent consisting of (a) 80% of a 40% aqueous solution of 2-ethylhexyl sulfate (sodium salt), (b) 3% of a 50% aqueous solution of monobutyl phosphate, (c) 1.3% of 2-ethyl-n-hexanol, (e) 0.5% of silicone surfactant L 546®, (f) 3.5% of sodium gluconate and (d) 11.7% of 2,4-dihydroxy-2-methylpentane. The temperature of the mercerising liquor is 18° C.

The fabric is then rinsed with hot water (70° C.) for 1 minute to remove residual liquor and is treated with cold water which contains per liter 5 ml of acetic acid (40%). The fabric is then rinsed, squeezed on a padmangle and is dried at 100° C. in a drying cabinet. The lustre and the dyeability of the fabric have been markedly improved.

What is claimed is:

1. A wetting agent which comprises (a) a sulfate of a fatty alcohol having 6 to 18 carbon atoms, (b) a phosphate of a monoalcohol having 4 to 12 carbon atoms, (c) an alcohol having 6 to 18 carbon atoms or a condensation product thereof with paraformaldehyde and (d) a hydrotrope.

2. A wetting agent of claim 1, which additionally comprises (e) an adduct of an organopolysiloxane with ethylene oxide or propylene oxide or a mixture thereof, and (f) a complexing agent.

3. A wetting agent of claim 2, wherein component (e) is an adduct of a dimethylpolysiloxane with ethylene oxide or propylene oxide or a mixture thereof.

4. A wetting agent of claim 3, wherein component (e) has a cloud point of 20° to 70° C.

5. A wetting agent of claim 4, wherein component (e) has a cloud point of 25° to 50° C.

6. A wetting agent according to claim 2, wherein component (f) is a compound of the formula

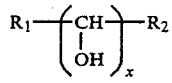

in which $R_1$ and $R_2$, independently of each other, are $-CH_2OH$, $-CHO$ or $-CO_2M$, M is hydrogen or an alkali metal, and x is 2 to 5.

7. A wetting agent of claim 6, wherein $R_1$ is $-CH_2OH$ and $R_2$ is $-CO_2M$.

8. A wetting agent of claim 2, wherein component (e) is the sodium salt of gluconic acid.

9. A wetting agent of claim 1, wherein component (a) is a sulfate of a fatty alcohol having 6 to 12 carbon atoms.

10. A wetting agent of claim 9, wherein component (a) is a sulfate of a fatty alcohol having 8 or 9 carbon atoms.

11. A wetting agent of claim 10, wherein component (a) is the sulfate of 2-ethylhexanol.

12. A wetting agent of claim 1, wherein component (b) is a phosphate of a monoalcohol having 4 to 6 carbon atoms.

13. A wetting agent of claim 12, wherein component (b) is monobutyl phosphate.

14. A wetting agent of claim 1, wherein component (c) is an alcohol having 6 to 12 carbon atoms.

15. A wetting agent of claim 14, wherein component (c) is 2-ethylhexanol.

16. A wetting agent of claim 1, wherein component (d) is a compound of the formula

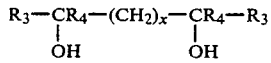

in which $R_3$ and $R_4$, independently of each other, are hydrogen or alkyl having 1 to 4 carbon atoms, and x is 2 to 5.

17. A wetting agent of claim 1, wherein component (d) is a compound of the formula

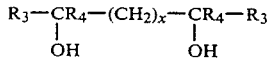

in which $R_3$ and $R_4$, independently of each other, are hydrogen or methyl.

18. A wetting agent of claim 11, wherein component (d) is 2-methyl-2,4-pentanediol.

19. A wetting agent of claim 1, which is in the form of an aqueous solution of components (a) to (d).

20. A wetting agent according to claim 19 wherein the aqueous solution further comprises one or both of components (e) and (f).

21. A wetting agent of claim 1, which comprises 5-50% of component (a), 0.5-30% of component (b), 0.5-5% of component (c), and 5-15% of component (d).

22. A wetting agent of claim 21, which comprises 25-40% of component (a), and 0.5-20% of component (b), 0.5-2% of component (c), and 10-15% of component (d).

23. A wetting agent according to claim 21 further comprising one or both of 0.1-1% of component (e) and 0.1-5% of component (f).

24. A mercerizing bath which comprises a wetting agent of claim 1.

25. A process for mercerizing cellulosic fibers, which comprises applying a mercerizing bath of claim 24 to the fibers.

26. A wetting agent according to claim 22, further comprising one or both of 0.1-0.5% of component (e) and 2-4% of component (f).

27. A wetting agent of claim 26, which comprises 30-35% of component (a), 0.5-10% of component (b), 1-1.5% of component (c), 10-15% of component (d), 0.1-0.5% of component (e) and 2-4% of component (f).

28. A mercerizing bath which comprises a wetting agent of claim 27.

29. A process for mercerizing yarn, which comprises applying a mercerizing bath of claim 28 to the yarn.

30. A process for reducing the degree of foaming in the recovery of liquor from mercerizing washing baths, which comprises adding a wetting agent of claim 1 to the mercerizing liquor.

* * * * *